United States Patent [19]

Gottlieb

[11] 3,954,391

[45] May 4, 1976

[54] PROCESS FOR ENDOTHERMIC HEAT TREATMENT OF MATERIALS

[75] Inventor: Steven Gottlieb, East Hawthorn, Australia

[73] Assignee: Gorresens Inc., Chicago, Ill.

[22] Filed: Sept. 23, 1974

[21] Appl. No.: 508,430

[52] U.S. Cl. ..... 432/14; 432/95; 432/106

[51] Int. Cl.[2] ..... F27B 15/00

[58] Field of Search ..... 432/14, 17, 106, 95, 432/96

[56] References Cited

UNITED STATES PATENTS

| | | | |
|---|---|---|---|
| 1,468,168 | 9/1923 | Pike | 432/106 |
| 2,464,304 | 3/1949 | Gottlieb | 432/17 |
| 3,285,590 | 11/1966 | Parsons | 432/14 |
| 3,834,860 | 9/1974 | Fukudg | 432/106 |

*Primary Examiner*—John J. Camby

*Attorney, Agent, or Firm*—Wegner, Stellman, McCord, Wiles & Wood

[57] ABSTRACT

Cement raw materials are precalcined prior to being sintered in a rotary kiln by feeding the materials in pelletised form downwardly through a gas or oil fired calciner in countercurrent to the flue gases drawn from the rotary kiln.

5 Claims, 1 Drawing Figure

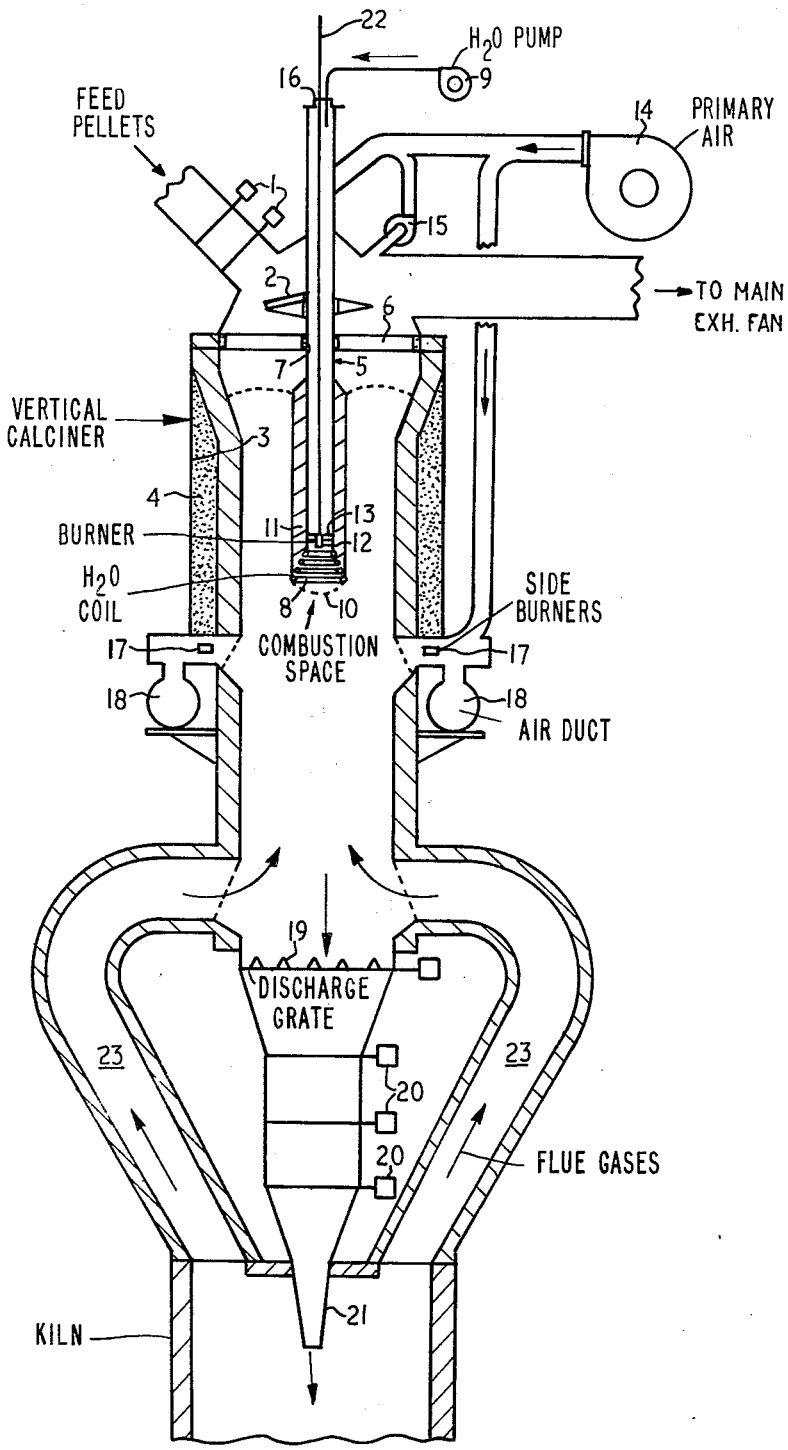
22
$H_2O$ PUMP
9
16
FEED PELLETS
14
PRIMARY AIR
1
15
2
TO MAIN EXH. FAN
6
7
5
VERTICAL CALCINER
3
4
13
BURNER
11
12
$H_2O$ COIL
8
10
SIDE BURNERS
17
COMBUSTION SPACE
17
18
18
AIR DUCT
19
DISCHARGE GRATE
23
23
20
20
FLUE GASES
21
KILN

PROCESS FOR ENDOTHERMIC HEAT TREATMENT OF MATERIALS

This invention relates to endothermic heat treatment of materials and more particularly to the manufacture of portland cement clinker.

The invention has applicability in the treatment of any materials involving an endothermic reaction which must be carried out at a temperature lower than that required for subsequent sintering or other chemical reaction and where the materials are capable of being heat-treated in pelletised form. Thus, for example, the invention may be applied to the calcination of cement raw mix materials prior to sintering and to similar preheat treatments of bauxite raw materials and of magnesite ore prior to chemical reaction.

In the manufacture of cement clinker in rotary kilns heat is required for decomposition of the calcium and magnesium carbonates (hereinafter referred as calcination). To convert $CaCO_3$ to CaO in cement raw mix, the amount of heat needed is approximately 425 kcal p.kg. of clinker. Additional heat is required to replace the amount of sensible heat lost by external radiation and in exit gases and exit product. Calcination commences already at 900°C and is completed before the temperature is further increased to the point of sintering, at which approximately 100 kcal p.kg. of clinker is recouped by exothermic reaction.

Calcination and sintering in a conventional cement rotary kiln cannot be performed very efficiently, particularly if the whole endothermic reaction load must be negotiated in the kiln, due to the nature of heat transfer: in conventional operation only about one fifth of the cross-sectional area of a rotary kiln is filled up by the slowly forward rolling material, presenting a relatively small surface to the flame which transfers its heat mainly by radiation, varying directly with the absolute temperature raised to the fourth power. Therefore a very high flame temperature is required to complete sintering while a large amount of surplus heat at high temperature remains in the gases after the raw material has become clinker in the hot zone. To recapture at least part of this surplus heat rotary kilns must be built very long — or coupled with convective heat exchanger systems which are capable of operation up to 1000°C — in order to improve heat transfer rate.

It is known to improve the heat efficiency of cement making rotary kilns by attaching heat exchangers to the feed end of the kiln, thus making use of convective heat transfer, with the application of chains, crosses and other devices to utilize the residual heat in the kiln gases. In recent years such heat exchangers have been designed as independent heat transfer units through which the flue gases from the kiln are forced to pass. It is also known to recapture residual heat in the kiln gases by using the raw materials in pelletized form. Only recently however, when the heat exchangers have been extended with separately fired fluid bed or flash furnace heaters has calcination occurred to any extend outside of the kiln.

The object of the invention is to improve the efficiency, in particular the thermal efficiency and increase the productive capacity of rotary kiln installations. The invention involves completing the endothermic calcination process in a countercurrent air/gas flow vertical kiln and offers many advantages over flash furnace or fluid bed heater systems interconnected with heat exchangers, viz:

1. Low capital cost due to relatively small, compact calciner application;
2. Low exit gas temperature conditioned with the right moisture content released by the pellets, to ensure optimal electrostatic dust precipitator operation;
3. Removal of the bulk of alkalies in the vertical calciner operation due to high velocity and turbulent flow of gases in the pellet bed, thus feeding practically alkali-free material into the rotary kiln;
4. Low heat consumption due to high convective heat transfer rate following the high velocity turbulent gas flow as referred to in 3) above;
5. Low maintenance cost due to relatively simple and compact plant;
6. No segregation, even with raw materials composed of limestone and clay having very different specific gravities.

Broadly in accordance with the present invention there is provided a process for the heat treatment of a material capable of undergoing an endothermic reaction in pelletised form and wherein the endothermic reaction must be carried out at a temperature lower than that required in a subsequent sintering or chemical reaction step which comprises feeding the material in pelletised form downwardly through a vertical calciner, drawing flue gases from a relatively short rotary kiln upwardly through the vertical calciner, and feeding additional heat into the calciner directed downwardly countercurrent to the main gas flow, the heat being introduced under controlled conditions whereby substantially complete calcination of the raw material is effected with substantially no sintering thereof so that the material emerges still in pelletised form ready for sintering or other reaction in the rotary kiln.

In a specific application of the present invention there is provided a process for the calcination of portland cement raw material components which comprises feeding proportioned cement raw materials in pelletised form downwardly through a vertical calciner, drawing flue gases from a relatively short rotary kiln upwardly through the vertical calciner, and feeding additional heat into the calciner directed downwardly counter-current to the main gas flow, the heat being introduced under controlled conditions whereby substantially complete calcination of the raw materials is effected with substantially no sintering thereof so that the materials emerge still in pelletised form ready for sintering in the rotary kiln.

The operation of a counter-current gas flow vertical calciner in accordance with the invention will be understood from the following description of a particular embodiment as illustratively shown in the accompanying drawing. Raw mix of the desired chemical composition and fineness is accurately proportioned and pelletised in a pan pelletiser of the type described in Australian Pat. No. 152,109. The pellets are fed through hydraulically operated alternating gates 1 into pellet feeder 2 which distributes the pellets evenly and maintains a constant pellet level in the hood. The calciner shell 3 is insulated throughout 4. An iron pipe 5 held in position by steel structure 6 bolted to the kiln shell 3 and adjustable by sleeve 7 is welded at its lower end to steel pipes 8, wound and welded into a bell-shaped structure in which water is circulated by a pump 9 at 5 atm. pressure. The bell provides combustion space in conjunction with the natural angle of repose 10 of the pellets underneath and also supports the firebrick lining 11 which protects iron pipe 5. A gas or oil burner nozzle 12 is situated in the centre of the bell neck, held in central position by a three-pronged ring 13. Gas or atomised oil 22 and air, blown into the calciner downwards into the pellet bed by primary air fan 14 produces a flame which can be tempered by a small, regulable quantity of flue gas drawn out of the main gas stream by flue gas recirculating fan 15. A window 16 on the top of the primary air pipe serves for observation of the flame formed deep inside the pellet bed in the approximate centre of the kiln.

In addition to the center burner, six circumferentially arranged side burners 17 supply heat into the perimeter of the calciner. Air is supplied to these burners through duct 18 by fan 14.

Flue gases from the rotary kiln with temperatures of up to 1000°C enter the calciner through two firebrick lined ducts 23 above the discharge grate 19 shown on the drawing as a reciprocating grate made up of heat resistant triangular bars, driven hydraulically, though other types of grates may also be used for this application. Calcined pellets from the grate 19 pass through alternating triple sealing gates 20 also operated hydraulically, from which they feed into the rotary kiln through heat resistant cast steel chute 21.

The temperature of the flue gases from the rotary kiln, streaming upward in the calciner, is boosted by further heat introduction of the center and circumferentially placed burners while the time period during which the pellets are kept at above calcination temperature is also extended. Centralised controls are provided which, though simple, very reliably provide the exact amount of additional heat, just to complete calcination but not more, so as to prevent sintering. As the temperature of the exit water from the coils making up bell 8 is proportional to the hot zone temperature, an electrical interlock between exit water temperature and discharge grate regulator greatly contributes towards maintaining uniform and exact temperature and timing conditions in the calciner. The countercurrent gas flows at high velocities and turbulencies within the voids formed by the pellets ensure excellent rate of heat transfer, thus very little heat additional to that supplied by the rotary kiln exit gas is needed to complete calcination. Heat transfer in the preheating zone of the calciner is also efficient which, together with the evaporation of water from the pellets assures low exit gas temperature.

The centralised controls, in addition to the electrical interlock between exit water temperature and discharge grate regulator already mentioned include television cameras to observe the pellet level and the central flame, a raw mix proportioning scale with push buttons to increase or decrease the pulverised material flow, control pelletiser, pellet feeder, water and gas temperature indicators, air and fuel flow rate indicators for the burners, and pressure to gauge resistance of pellet bed in the calciner. Instrumentation of the whole system be placed into one single centralised control panel.

What I claim is:

1. A process for the heat treatment of a material capable of undergoing an endothermic reaction and capable of being shaped in the form of pellets, comprising: providing said material in the form of shaped pellets; feeding said pellets downwardly through a vertical calciner; heating said pellets by drawing a flow of heated flue gases through the interstices, voids and narrow channels between said pellets in the vertical calciner to induce high velocity turbulent gas flow over and through the pellets in said calciner, said heated gas being provided from a short rotary kiln; supplying additional heat to the pellets in said calciner by directing said additional heat countercurrently in said calciner to said flow of said flue gases, said additional heat providing substantially complete calcination without substantial sintering of said material in said pellets; and directing the resulting calcined material still in pellet form into said kiln from which said heating flue gases are drawn.

2. The process of claim 1 wherein said drawing of the flow of flue gases is upwardly through said calciner and said supplying of additional heat is downwardly directed through said pellets in the calciner.

3. A process as claimed in claim 1 wherein the downwardly directed additional heat is supplemented by heat introduced into the calciner horizontally and circumferentially.

4. A process as claimed in claim 3 wherein a controlled amount of flue gas from the calciner is recycled and proportioned to the air feeding to the central and circumferential burners.

5. A process as claimed in claim 1 wherein the downwardly directed additional heat is supplemented by heat introduced into the calciner horizontally and circumferentially, the downwardly directed additional heat is provided from a burner for fluid fuel situated in a combustion chamber formed from a bell-shaped extension of an axially located air and fuel inlet pipe, a controlled amount of flue gas from the calciner is recycled and proportioned to the air feeding to the central and circumferential burners, and said extension is formed from windings of pipe through which water is circulated under pressure.

* * * * *